US008853599B2

(12) United States Patent
Kusaka et al.

(10) Patent No.: US 8,853,599 B2
(45) Date of Patent: Oct. 7, 2014

(54) INDUCTION HEATING COOKING APPARATUS

(75) Inventors: Takaaki Kusaka, Hyogo (JP); Akira Kataoka, Shiga (JP); Kazunori Takechi, Hyogo (JP)

(73) Assignee: Panasonic Corporation, Osaka (JP)

( * ) Notice: Subject to any disclaimer, the term of this patent is extended or adjusted under 35 U.S.C. 154(b) by 173 days.

(21) Appl. No.: 12/994,051

(22) PCT Filed: May 26, 2009

(86) PCT No.: PCT/JP2009/002309

§ 371 (c)(1),
(2), (4) Date: Nov. 22, 2010

(87) PCT Pub. No.: WO2009/144916

PCT Pub. Date: Dec. 3, 2009

(65) Prior Publication Data

US 2011/0073588 A1 Mar. 31, 2011

(30) Foreign Application Priority Data

May 27, 2008 (JP) ..... 2008-137584
May 28, 2008 (JP) ..... 2008-139195

(51) Int. Cl.
*H05B 6/12* (2006.01)
*H05B 6/36* (2006.01)
*H05B 6/42* (2006.01)
*H05B 6/06* (2006.01)

(52) U.S. Cl.
CPC ..... *H05B 6/1263* (2013.01); *H05B 2213/07* (2013.01); *H05B 6/062* (2013.01)
USPC ..... 219/623; 219/622; 219/624; 219/627; 219/676; 219/677

(58) Field of Classification Search
USPC ..... 219/447.1, 446.1, 448.11, 448.12, 219/448.13, 620, 621, 623, 624, 627, 625, 219/647, 660, 663, 667, 411, 622, 672, 676, 219/677; 374/130, 131; 126/213, 214 D, 126/21 R, 21 A; 99/DIG. 14
See application file for complete search history.

(56) References Cited

U.S. PATENT DOCUMENTS 3,710,062 A 1/1973 Peters, Jr.
3,887,781 A 6/1975 Peters, Jr.

(Continued)

FOREIGN PATENT DOCUMENTS

JP 53-022289 B 7/1978
JP 11-354264 A 12/1999

(Continued)

OTHER PUBLICATIONS

English Translation of Nojiri et al. (JP 2004-063451), Feb. 26, 2004.*

(Continued)

*Primary Examiner* — Henry Yuen
*Assistant Examiner* — Hung D Nguyen
(74) *Attorney, Agent, or Firm* — Brinks Gilson & Lione

(57) ABSTRACT

An induction heating cooking apparatus includes a magnetic flux-shielding plate 28 to restrain magnetic flux leakage from a heating coil 24 and define a cooling air trunk 33, through which cooling air from a fan 32 passes. An infrared sensor 26 for detecting infrared rays emitted from a cooking container 22 and a control circuit 27 for controlling an output of a heating coil 24 depending on an output from the infrared sensor 26 are accommodated within the same space with respect to the magnetic flux-shielding plate 28 to thereby enhance assemblage. Also, the infrared sensor 26 is mainly cooled by cooling air passing through a cooling air trunk 33 to thereby enhance the cooling efficiency of the infrared sensor 26 and conduct correct temperature detection.

7 Claims, 3 Drawing Sheets

(56) References Cited

U.S. PATENT DOCUMENTS

| | | | | |
|---|---|---|---|---|
| 3,953,783 | A | 4/1976 | Peters, Jr. | |
| 4,151,387 | A | 4/1979 | Peters, Jr. | |
| 5,488,214 | A * | 1/1996 | Fettig et al. | 219/622 |
| 2003/0164370 | A1* | 9/2003 | Aihara et al. | 219/622 |
| 2005/0242085 | A1 | 11/2005 | Kaji et al. | |
| 2005/0242088 | A1 | 11/2005 | Takada et al. | |
| 2008/0142512 | A1* | 6/2008 | Kim et al. | 219/757 |
| 2009/0314771 | A1 | 12/2009 | Okada et al. | |

FOREIGN PATENT DOCUMENTS

| | | | |
|---|---|---|---|
| JP | 2001-355852 | A * | 12/2001 |
| JP | 2004-063451 | A * | 2/2004 |
| JP | 2004-273303 | A | 9/2004 |
| JP | 2005-026162 | A | 1/2005 |
| JP | 2005-122962 | A | 5/2005 |
| JP | 2005-149829 | A | 6/2005 |
| JP | 2005-216586 | A | 8/2005 |
| WO | WO 2008/075673 | A1 | 6/2008 |

OTHER PUBLICATIONS

English translation of Otsuki et al.; JP 2001-355852; Dec. 2001.*

English translation Abstract of Otsuki et al.; JP 2001-355852; Dec. 2001.*

International Search Report for International Application No. PCT/JP2009/002309, dated Sep. 8, 2009, 2 pages.

International Preliminary Report on Patentability from counterpart International Application No. PCT/JP2009/002309, dated Jan. 11, 2011, 5 pages.

Office Action from counterpart Canadian Application No. 2,724,498, dated Oct. 4, 2013, 3 pages.

Extended European Search Report in corresponding European Application No. 09754425.8, dated Jan. 27, 2014, 8 pages.

* cited by examiner

INDUCTION HEATING COOKING APPARATUS

TECHNICAL FIELD

The present invention relates to an induction heating cooking apparatus having an infrared sensor.

BACKGROUND ART

Conventionally, an induction heating cooking apparatus of this kind includes a top plate for placing a cooking container thereon, a heating coil disposed below a location where the cooking container is placed, a magnetic flux-shielding member disposed in the vicinity of the heating coil to restrain magnetic flux leakage from the heating coil, an infrared sensor for receiving infrared rays emitted from the cooking container on the top plate and outputting a detection signal depending on the amount of light received, and a control circuit for controlling an output of the heating coil based on the detection signal, wherein the infrared sensor is positioned below the magnetic flux-shielding member (see, for example, Patent Document 1).

FIG. 6 depicts a conventional induction heating cooking apparatus, which includes a main body 1 forming an outer shell, a top plate 3 mounted on an upper surface of the main body 1 to place a cooking container 2 thereon, and a heating coil 4 disposed below the top plate 3 to induction heat the cooking container 2. A plurality of ferromagnetic ferrite materials 5 having a magnetic flux-collecting effect are disposed below the heating coil 4 so as to extend radially from a center of the heating coil 4, as viewed from above, to control magnetic flux that is directed downwardly from the heating coil 4.

An infrared sensor 6 is disposed below the heating coil 4 that induction heats a bottom surface of the cooking container 2. The infrared sensor 6 detects infrared rays emitted from the bottom surface of the cooking container 2 through the top plate 3 and outputs a signal depending on a temperature of the bottom surface of the cooking container 2. A control circuit 7 is disposed below the infrared sensor 6 to control an output of the heating coil 4 based on the signal outputted from the infrared sensor 6.

The control circuit 7 is accommodated within a cooling air trunk 11 defined between a bottom wall of the main body 1 and a partition plate 10 disposed below the heating coil 4. Heat-generating components 8 constituting the control circuit 7 such as an IGBT mounted to a heat sink 8*a*, a resonance capacitor, and the like are fixedly mounted on a control board 7*a* and cooled to a desired temperature by a fan 9 mounted in the main body 1.

The heating coil 4 is placed on an upper surface of a coil base 13, in which the ferrite materials 5 are accommodated, and fixed thereto, for example, by bonding. The coil base 13 is supported by a plurality of springs 12 mounted on the partition plate 10 and is pressed against a lower surface of the top plate 3 by the springs 12 via a spacer 16 that provides a space between an upper surface of the heating coil 4 and the top plate 3. The infrared sensor 6 is disposed below the ferrite materials 5 and above the partition plate 10. The influence of magnetic flux on the infrared sensor 6 is reduced by the magnetic flux-collecting effect of the ferrite materials 5.

Further, in order to eliminate the influence of magnetic flux leakage, the infrared sensor 6 is encircled by a magnetic flux-shielding casing 14 made of, for example, aluminum and having a magnetic flux-shielding effect. The infrared sensor 6 must be cooled to a desired temperature, because the infrared sensor 6 is heated and the temperature thereof increases by heat generated from the heating coil 4 and the cooking container 2. To this end, the partition plate 10 has a vent hole 15 defined therein in the vicinity of the infrared sensor 6, and part of cooling air passing through the cooling air trunk 11 passes through the vent hole 15 to cool the infrared sensor 6.

By this construction, the conventional induction heating cooking apparatus having the infrared sensor can conduct stable temperature detection with the use of the infrared sensor without being affected by the magnetic flux leakage from the heating coil.

PRIOR ART DOCUMENT

Patent Document 1: Japanese Laid-Open Patent Publication No. 2004-273303

SUMMARY OF THE INVENTION

Problems to be Solved by the Invention

In the above-described conventional construction, however, because the infrared sensor 6 is encircled by the magnetic flux-shielding casing 14, and the partition plate 10 is interposed between the infrared sensor 6 and the control circuit 7, there arises a problem with assemblage and, for example, wiring of signal wires for connecting the infrared sensor 6 and the control circuit 7 is complicated.

Also, because the infrared sensor 6 is cooled by part of the cooling air passing through the cooling air trunk 11, i.e., the cooling air passing through the vent hole 15, a volume of cooling air sufficient to cool the infrared sensor 6 does not reach the magnetic flux-shielding casing 14, thus making it difficult to conduct correct temperature detection.

The present invention has been developed to overcome the above-described disadvantages.

It is accordingly an objective of the present invention to provide an induction heating cooking apparatus that is simple in construction and assemblage and capable of conducting correct temperature detection by minimizing a temperature rise of the infrared sensor.

Means to Solve the Problems

In accomplishing the above objective, the induction heating cooking apparatus according to the present invention includes an infrared sensor positioned below a magnetic flux-shielding plate that is interposed between a control circuit and ferrite materials disposed below a heating coil, and cooling air is conveyed toward the infrared sensor along a lower surface of the magnetic flux-shielding plate.

By this construction, the infrared sensor and the control circuit are accommodated within the same space and, hence, the number of component parts intervening between the infrared sensor and the control circuit can be reduced, thus making it possible to enhance assemblage. Also, because the space below the magnetic flux-shielding plate defines a cooling air trunk for cooling the infrared sensor, and the control circuit is positioned within the cooling air trunk, both the control circuit and the infrared sensor are efficiently cooled by the cooling air from the same cooling device, thereby restraining a temperature rise of the infrared sensor, accompanied by correct temperature detection.

Effects of the Invention

The induction heating cooking apparatus according to the present invention is simple in construction, facilitates assemblage, and restrains the influence of an electromagnetic field on the infrared sensor and a temperature rise of the infrared sensor for realization of correct temperature detection.

DETAILED DESCRIPTION OF THE PREFERRED EMBODIMENTS

Figure 1:
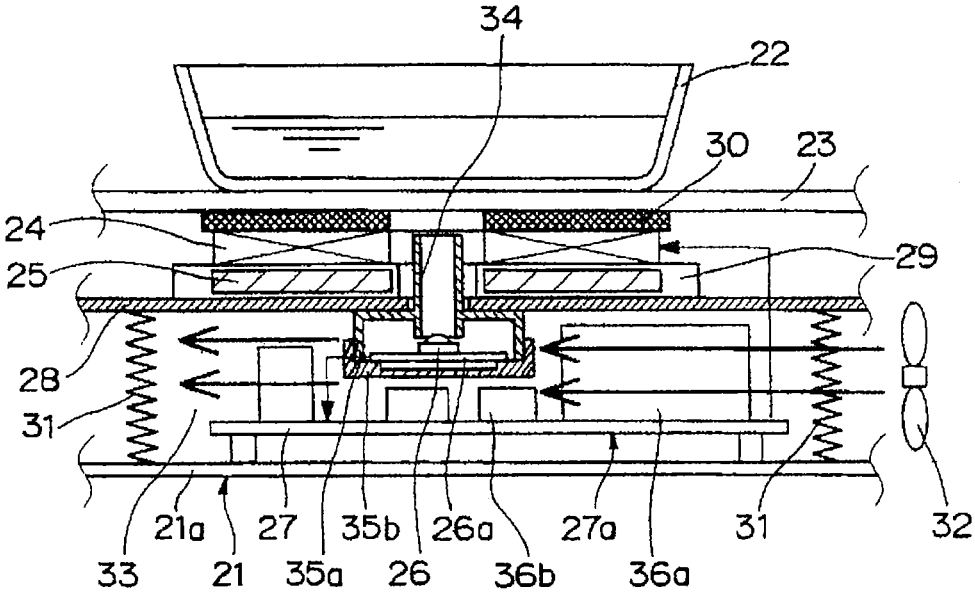
FIG. 1 is a sectional view of an induction heating cooking apparatus according to a first embodiment of the present invention.

A first invention provides an induction heating cooking apparatus, which includes a main body, a top plate mounted on an upper surface of the main body to place a cooking container thereon, a heating coil disposed below the top plate to heat the cooking container, a plurality of ferrite materials disposed below the heating coil so as to extend radially from a center of the heating coil, a heating coil holding plate holding the heating coil and the ferrite materials, an infrared sensor disposed below the top plate to detect infrared rays emitted from the cooking container, and a control circuit disposed below the ferrite materials and including an inverter circuit operable to generate a high frequency current to be supplied to the heating coil and a semiconductor element operable to drive the inverter circuit, the control circuit controlling an output of the heating coil depending on an output from the infrared sensor. This induction heating cooking apparatus also includes a plurality of cooling fins operable to cool the semiconductor element mounted thereto, a magnetic flux-shielding plate interposed between the ferrite materials and the control circuit and made of a metal plate to shield magnetic flux leakage downward from the ferrite materials, and a fan operable to convey cooling air to cool the control circuit. The infrared sensor is positioned below the magnetic flux-shielding plate, and the fan conveys the cooling air toward the infrared sensor along a lower surface of the magnetic flux-shielding plate.

In this construction, because the magnetic flux-shielding plate is not positioned between the infrared sensor and the control circuit, assemblage of the apparatus is enhanced. Also, because the space below the magnetic flux-shielding plate defines a cooling air trunk for cooling the infrared sensor, and the control circuit is positioned within the cooling air trunk, both the control circuit and the infrared sensor are efficiently cooled by the cooling air from the same cooling device, thereby enhancing the cooling efficiency of the infrared sensor, accompanied by correct temperature detection.

In a second invention, the induction heating cooking apparatus further includes a cylindrical member interposed between the infrared sensor and the top plate so as to extend through the magnetic flux-shielding plate, wherein infrared rays emitted from the cooking container pass through the cylindrical member.

Because an end surface of the cylindrical member can be positioned close to the infrared sensor, infrared rays other than those from the cooking container are controlled so as not to enter the infrared sensor, i.e., the influence of ambient light on the infrared sensor is minimized. Accordingly, the degree of freedom in vertical level of the infrared sensor is increased, thus resulting in an increase of the cooling performance.

In a third invention, the infrared sensor and the cooling fins are positioned in parallel to each other with respect to the fan so that cooling air from the fan to cool the infrared sensor and cooling air from the fan to cool the cooling fins flow in parallel to each other. By so doing, the infrared sensor can be effectively cooled using strong cooling air passing through heat-generating components.

In a fourth invention, the induction heating cooking apparatus further includes a duct juxtaposed with the cooling fins to lead cooling air from the fan toward the infrared sensor. Accordingly, strong cooling air from the fan can be directly led to the infrared sensor, thus further enhancing the cooling efficiency of the infrared sensor.

In a fifth invention, the induction heating cooking apparatus further includes a light emitting ring encircling an outer periphery of the heating coil. Also, the top plate includes a light shielding film formed on a lower surface thereof confronting the heating coil to shield light and a light transmitting portion formed on the lower surface of the top plate to allow transmission of light by removing a portion of the light shielding film at a location confronting the light emitting ring, wherein the magnetic flux-shielding plate confronts the light transmitting portion.

The magnetic flux-shielding plate acts to shield ambient light entering the infrared sensor through the top plate to thereby reduce the influence of ambient light on the infrared sensor positioned below the magnetic flux-shielding plate, thus resulting in stable temperature detection.

In a sixth invention, the induction heating cooking apparatus further includes a light absorbing film formed on the magnetic flux-shielding plate. Because ambient light entering through the top plate is absorbed by the magnetic flux-shielding plate, the effect of shielding ambient light is further enhanced, thus enabling more stable temperature detection.

In a seventh invention, the induction heating cooking apparatus further includes a casing mounted to a lower surface of the heating coil holding plate to accommodate the infrared sensor therein, the casing extending through the magnetic flux-shielding plate. This construction allows the apparatus to be assembled under the condition in which the infrared sensor has been mounted to the heating coil holding plate, thus making it possible to simplify assembling and disassembling operations.

In an eighth invention, a detection circuit for detecting an output from the infrared sensor is provided, and the casing is formed of a conductive metallic material and held in contact with the detection circuit, but electrically insulated from the magnetic flux-shielding plate. This construction prevents an electric current from flowing into the detection circuit through the magnetic flux-shielding plate.

Embodiments of the present invention are explained hereinafter with reference to the drawings, but the present invention is not limited by such embodiments.

Embodiment 1

FIG. 1 is a sectional view of an essential portion of an induction heating cooking apparatus according to a first embodiment of the present invention.

The induction heating cooking apparatus includes a main body 21 in the form of a box-shaped outer shell opening upward and having a bottom wall 21*a* and a plurality of side walls (not shown). A top plate 23 is mounted on an upper surface of the main body 21 to place a cooking container 22 thereon, and a heating coil 24 is disposed below the top plate 23 to induction heat the cooking container 22. A plurality of bar-shaped ferromagnetic ferrite materials 25 having a magnetic flux-collecting effect are disposed below the heating coil 24 so as to extend radially from a center of the heating coil 24, as viewed from above. The ferrite materials 25 have a magnetic flux-collecting effect to restrain magnetic flux, which is directed downwardly from the heating coil 24, from spreading downwardly apart from the heating coil 24.

An infrared sensor 26 is disposed below the heating coil 24. The infrared sensor 26 detects infrared rays emitted from a bottom surface of the cooking container 22 through the top plate 23 and outputs a signal depending on a temperature of the bottom surface of the cooking container 22. A control circuit 27 is formed on a printed circuit board and disposed below the heating coil 24 in the vicinity of the infrared sensor 26. The control circuit 27 includes an inverter circuit formed by semiconductor elements 36*c* such as, for example, IGBTs and rectifiers mounted to and cooled by a heat sink (cooling fins) 36*a*, and resonance capacitors 36*b*. The control circuit 27 also includes a controller for the inverter circuit and generates a high frequency current to be supplied to the heating coil 24. The control circuit 27 controls an output of the heating coil 24 based on the signal outputted from the infrared sensor 26.

The infrared sensor 26 and the control circuit 27 are disposed below the ferrite materials 25, and the influence of magnetic flux, generated from the heating coil 24, on the infrared sensor 26 and the control circuit 27 is reduced by the magnetic flux-collecting effect of the ferrite materials 25. Further, in order to eliminate the influence of magnetic flux leakage downward from the ferrite materials 25, a magnetic flux-shielding plate 28 made of a metal plate such as, for example, an aluminum plate and having a magnetic flux-shielding effect is interposed between the ferrite materials 25 and the control circuit 27 to partition a space on the side of the heating coil 24 and another space on the side of the control circuit 27. The heating coil 24 and the ferrite materials 25 are held by a coil base (heating coil holding plate) 29. The heating coil 24 is placed on an upper surface of the coil base 29 and fixed thereto, for example, by bonding. The ferrite materials 25 may be embedded in the coil base 29 by insert molding or bonded to a lower surface of the coil base 29.

A heat insulating material 30 made of, for example, ceramic fibers is interposed between the top plate 23 and the heating coil 24 to reduce a thermal effect of the heated cooking container 22 on the heating coil 24. The coil base 29 is placed on the magnetic flux-shielding plate 28, and the heating coil 24 is placed on the coil base 29. In this way, the magnetic flux-shielding plate 28 supports the heating coil 24 from below via the coil base 29. The magnetic flux-shielding plate 28 is biased upwardly by a plurality of springs 31 mounted on the bottom wall 21*a* of the main body 21. The magnetic flux-shielding plate 28 so biased in turn presses the heating coil 24 against a lower surface of the top plate 23 via the heat insulating material 30.

A space between the bottom wall 21*a* of the main body 21 and the magnetic flux-shielding plate 28 defines a cooling air trunk 33, in which the control circuit 27 is positioned so that cooling air may be conveyed toward a control board 27*a* and the infrared sensor 26 along a lower surface of the magnetic flux-shielding plate 28. The infrared sensor 26 and heat-generating components constituting the control circuit 27 and including semiconductor elements 36*c* such as IGBTs, rectifiers and the like fixed to and thermally connected to the heat sink 36*a*, and resonance capacitors 36*b* are cooled by cooling air generated by a fan 32 mounted in the main body 21.

A cylindrical member 34 made of a resin is disposed between the top plate 23 and the infrared sensor 26 so as to extend through the magnetic flux-shielding plate 28. The cylindrical member 34 is unitarily formed with an upper casing 35*a* that is fixed to a lower surface of the magnetic flux-shielding plate 28 by means of mounting pieces and screws (not shown) so as to cover the infrared sensor 26. The infrared sensor 26 is soldered to a printed circuit board 26*a*, which forms a detection circuit including an amplifier circuit, and is placed on and fixed to a lower casing 35*b*. The upper casing 35*a* has an opening defined in a lower portion thereof, with which the lower casing 35*b* engages such that the infrared sensor 26 is accommodated within the casing made up of the upper and lower casings 35*a*, 35*b*. The upper casing 35*a* is formed of a resin together with the cylindrical member 34, while the lower casing 35*b* may be formed of a resin or a conductive metal. If the lower casing 35*b* is formed of a conductive metal such as aluminum, a magnetic flux-shielding effect for reducing external noises (e.g., electromagnetic waves generated by the inverter) that may reach the infrared sensor 26 can be obtained.

The induction heating cooking apparatus of the above-described construction operates as follows.

The induction heating cooking apparatus according to this embodiment includes the magnetic flux-shielding plate 28 made of a metal plate and interposed between the ferrite materials 25 and the control circuit 27 to shield magnetic flux leakage downward from the ferrite materials 25. The magnetic flux-shielding plate 28 acts to reduce the quantity of magnetic flux that may leak from the heating coil 24 toward the control circuit 27, thus preventing erroneous operation of the control circuit 27. Also, the infrared sensor 26 and the control circuit 27 are both disposed below the magnetic flux-shielding plate 28 to receive cooling air conveyed from the fan 32 along a lower surface of the magnetic flux-shielding plate 28. Because the infrared sensor 26 and the control circuit 27 are positioned within the same space, and because no magnetic flux-shielding plate is interposed between the infrared sensor 26 and the control circuit 27, wiring between the infrared sensor 26 and the control board 27*a* is simplified, thus facilitating assemblage. Further, because the infrared sensor 26 and the control circuit 27 are accommodated within a space that is delimited by the magnetic flux-shielding plate 28 and the bottom wall 21*a* of the main body 21 to define the cooling air trunk 33, the infrared sensor 26 is cooled mainly by cooling air passing though the cooling air trunk 33, thus making it possible to enhance the cooling efficiency of the infrared sensor 26 and conduct correct temperature detection.

In the above-described embodiment, the cylindrical member 34 is provided between the infrared sensor 26 and the top plate 23 so as to extend through the magnetic flux-shielding plate 28, and infrared rays pass through the cylindrical member 34. Accordingly, by positioning a lower end of the cylindrical member 34 close to the infrared sensor 26 and an upper end of the cylindrical member 34 close to the top plate 23, light entering the infrared sensor 26 other than light from a portion of the cooking container 22 where temperature detection is desired can be shielded, thus making it possible to minimize instability of the output of the infrared sensor 26 that has been hitherto caused by ambient light. Also, such positioning of the respective ends of the cylindrical member 34 can increase the degree of freedom in vertical level of the infrared sensor 26 and, hence, the infrared sensor 26 can be positioned at a location where the air speed is high, thus resulting in an increase of the cooling performance.

Although in the above-described embodiment the cylindrical member 34 is of one-piece construction or continuous above and below the magnetic flux-shielding plate 28, the cylindrical member 34 may be separable above and below the magnetic flux-shielding plate 28. That is, if a continuous hole is defined above and below the magnetic flux-shielding plate 28, desired effects can be obtained.

Embodiment 2

Figure 2:
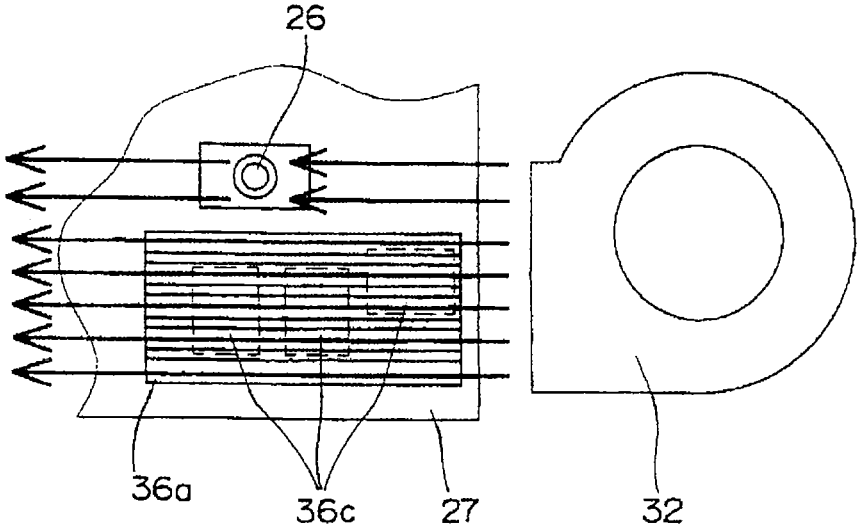
FIG. 2 is a top plan view of a cooling air trunk defined in an induction heating cooking apparatus according to a second embodiment of the present invention.

FIG. 2 is a top plan view of a cooling air trunk defined in an induction heating cooking apparatus according to a second embodiment of the present invention. Because the basic construction of the second embodiment is the same as that of the first embodiment, duplicative explanation thereof is omitted, and only differences are mainly explained hereinafter. The same component parts as those of the first embodiment shown in FIG. 1 are designated by the same reference numerals.

In FIG. 2, cooling air from the fan 32 to cool the infrared sensor 26 and cooling air from the fan 32 to cool the heat sink (cooling fins) 36*a*, to which the heat-generating components on the control circuit 27, i.e., the semiconductor elements 36*c* such as IGBTs, rectifiers and the like are fixed, flow in parallel to each other, as shown by arrows in FIG. 2. That is, the infrared sensor 26 and the heat sink 36*a* are positioned in parallel to each other with respect to the fan 32. This arrangement can efficiently utilize the cooling air from the fan 32 for the cooling of the infrared sensor 26 to thereby enhance the cooling effect on the infrared sensor 26.

Embodiment 3

Figure 3:
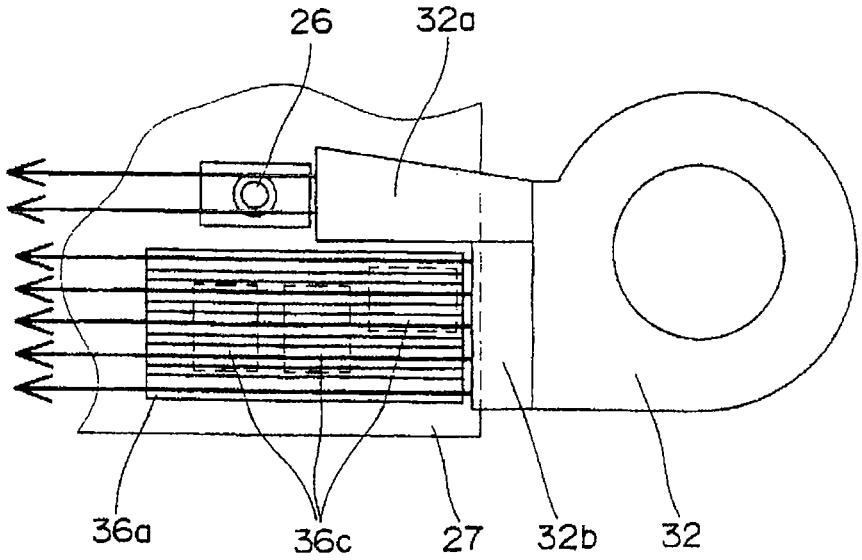
FIG. 3 is a top plan view of a cooling air trunk defined in an induction heating cooking apparatus according to a third embodiment of the present invention.

FIG. 3 is a top plan view of a cooling air trunk defined in an induction heating cooking apparatus according to a third embodiment of the present invention. Because the basic construction of the third embodiment is the same as that of the second embodiment, duplicative explanation thereof is omitted, and only differences are mainly explained hereinafter. The same component parts as those of the second embodiment shown in FIG. 2 are designated by the same reference numerals.

In FIG. 3, cooling air from the fan 32 flows in a direction as shown by arrows via a heat-generating component cooling duct 32*b* to cool the heat-generating components on the control circuit 27, i.e., the semiconductor elements 36*c* such as IGBTs, rectifiers and the like fixed to the heat sink 36*a*. In this embodiment, another duct 32*a* is provided separately from the heat-generating component cooling duct 32*b* to lead cooling air toward the infrared sensor 26. This arrangement can directly lead the cooling air from the fan 32 to the infrared sensor 26 to thereby further enhance the cooling effect on the infrared sensor 26.

Embodiment 4

Figure 4:
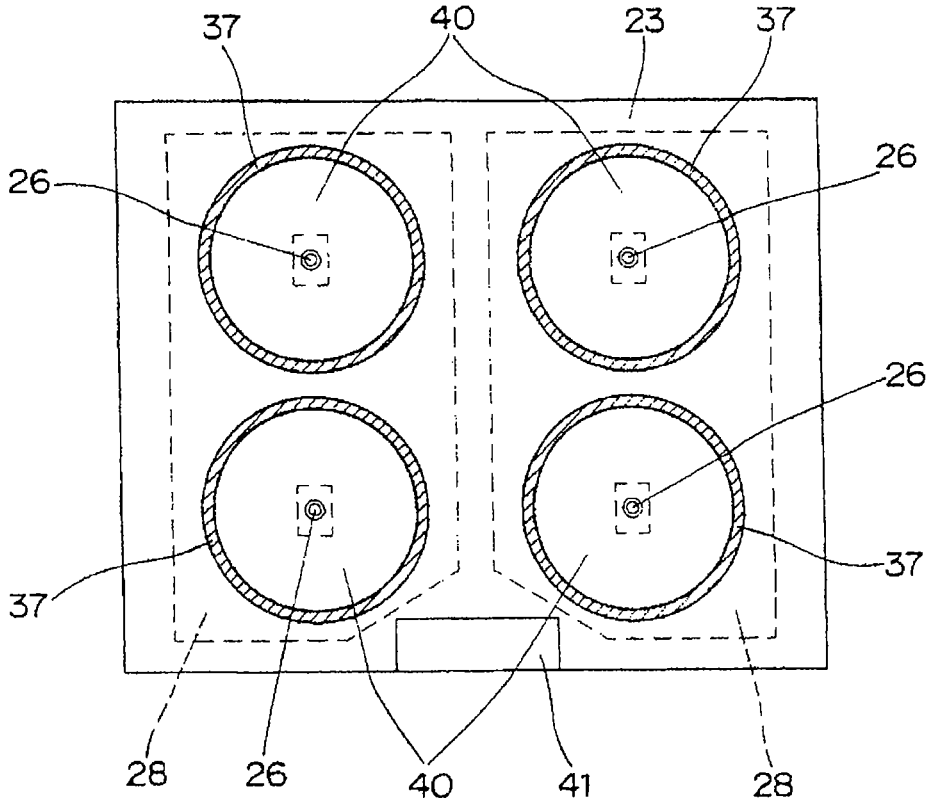
FIG. 4 is a top plan view of an induction heating cooking apparatus according to a fourth embodiment of the present invention.

FIG. 4 is a top plan view of an induction heating cooking apparatus according to a fourth embodiment of the present invention. Because the basic construction of the fourth embodiment is the same as that of the first embodiment, duplicative explanation thereof is omitted, and only differences are mainly explained hereinafter. The same component parts as those of the first embodiment shown in FIG. 1 are designated by the same reference numerals.

In FIG. 4, a top plate 23 includes four heating zones 40, on each of which a cooking container 22 is to be placed, and a control/display portion 41 provided at a front portion thereof for heating operations and display. As explained in the first embodiment, a heating coil (not shown) is supported by a magnetic flux-shielding plate 28 (indicated by dotted lines in FIG. 4) at a location below each heating zone 40. In this embodiment, four light emitting rings 39 each made up of an LED or LEDs and an annular light guide are provided below the top plate 23 to allow a user to easily recognize respective heating zones 40 (see FIG. 5). Each light emitting ring 39 emits light upwardly through a light transmitting portion 37 formed on the top plate 23 to form an annular luminous ring. A light shielding film 38 for shielding light is formed on a lower surface of the top plate 23 except the light transmitting portion 37 by, for example, painting (see FIG. 5). The magnetic flux-shielding plate 28 confronts the light transmitting portion 37.

As described above, in this embodiment, because the magnetic flux-shielding plate 28 is positioned so as to confront the light transmitting portion 37 of the top plate 23, the magnetic flux-shielding plate 28 acts to shield ambient light entering through the light transmitting portion 37 of the top plate 23 to reduce the influence of the ambient light on the infrared sensor 26 positioned below the magnetic flux-shielding plate 28, thus enabling stable temperature detection. In addition to the above-described construction, if a surface of the magnetic flux-shielding plate 28 is covered with a light-absorbing material by painting or printing in black, ambient light entering through the top plate 23 is absorbed by the magnetic flux-shielding plate 28. As a result, the effect of shielding the ambient light is further enhanced to enable more stable temperature detection.

Although in this embodiment the light transmitting portion 37 is in the form of a ring, as with the light emitting ring 39, the shape, position, and object of the light transmitting portion 37 is not limited thereto.

Embodiment 5

Figure 5:
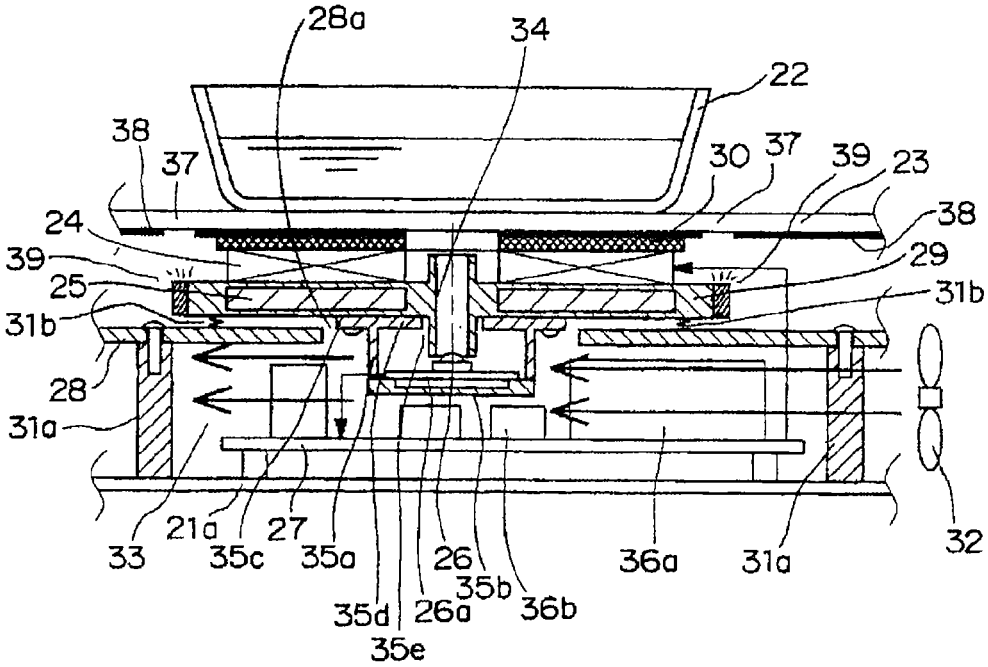
FIG. 5 is a sectional view of an induction heating cooking apparatus according to a fifth embodiment of the present invention.
Figure 6:
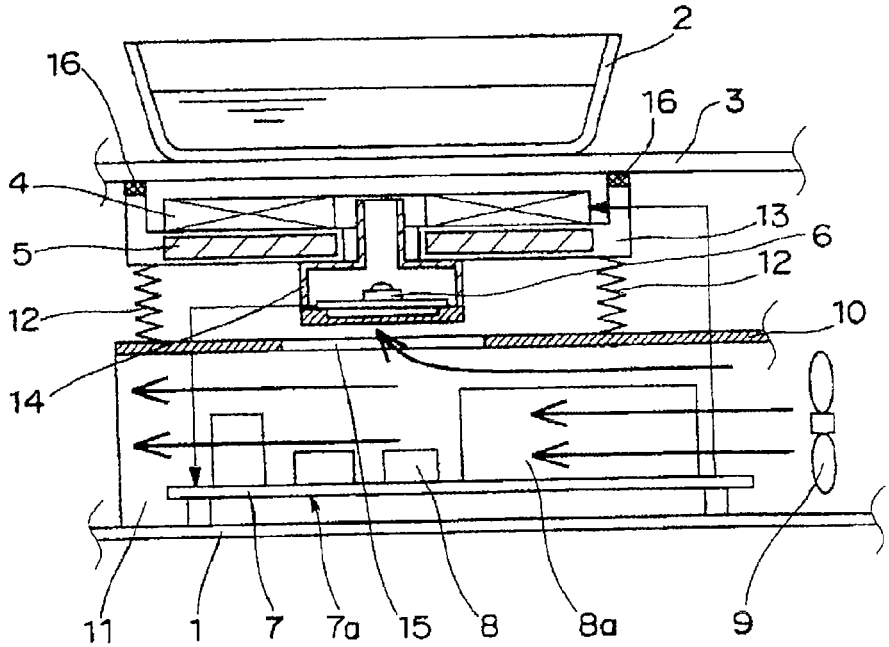
Fig. 6 Prior Art
FIG. 6 is a sectional view of a conventional induction heating cooking apparatus.

FIG. 5 is a sectional view of an essential portion of an induction heating cooking apparatus according to a fifth embodiment of the present invention. Because the basic construction of the fifth embodiment is the same as that of the first embodiment, duplicative explanation thereof is omitted, and only differences are mainly explained hereinafter. The same component parts as those of the first embodiment shown in FIG. 1 are designated by the same reference numerals.

As shown in FIG. 5, a magnetic flux-shielding plate 28 is supported by a plurality of supports 31 a secured to the bottom wall 21*a* of the main body 21, and a coil base 29 is supported and biased against the top plate 23 by a plurality of springs 31*b* mounted on an upper surface of the magnetic flux-shielding plate 28. Upper and lower casings 35*a*, 35*b* accommodating the infrared sensor 26 are formed of aluminum that is a conductive metallic material. A cylindrical member 34 is unitarily formed with the coil base 29 by resin molding.

The upper casing 35*a* has a flange 35*c* screwed to a lower surface of the coil base 29. Accordingly, the casing made up of the upper and lower casings 35*a*, 35*b* is secured to the lower surface of the coil base 29. The upper casing 35*a* also has an upper wall 35*d* having a through-hole 35*e* defined therein, in which a lower portion of the cylindrical member 34 is inserted so that a lower end of the cylindrical member 34 may be positioned close to the infrared sensor 26 disposed below the magnetic flux-shielding plate 28. The magnetic flux-shielding plate 28 has a through-hole 28*a* defined therein, and when the coil base 29 is placed on upper ends of the springs 31*b*, the casing 35*a*, 35*b* are inserted into the through-hole 28*a*.

By the above-described construction, the induction heating cooking apparatus according to this embodiment brings about the same effects as brought about by the induction heating cooking apparatus according to the first embodiment. Also, the magnetic flux-shielding plate 28 is fixed, making it possible to easily assemble the apparatus. Further, because the infrared sensor 26 is mounted to the coil base 29, the apparatus can be assembled under the condition in which the infrared sensor 26 has been mounted to the coil base 29, thus making it possible to simplify assembling and disassembling operations.

In addition, because the conductive magnetic flux-shielding plate 28 and the conductive casing 35*a*, 35*b* can be electrically insulated from each other, a potential of the conductive casing 35*a*, 35*b* can be made equal to that of a detection circuit 26*a* for the infrared sensor 26, while a potential of the magnetic flux-shielding plate 28 can be made different from that of the detection circuit 26*a* for the infrared sensor 26 or equal to that of the main body 21, which is often made equal to that of the earth. By so doing, operation of the infrared sensor 26 can be stabilized for accurate control of the temperature of the cooking container.

It is to be noted that the constructions as explained in the first to fifth embodiments can be appropriately combined.

INDUSTRIAL APPLICABILITY

As described above, because the present invention can enhance the performance of an induction heating cooking apparatus with an infrared sensor and facilitate assembling work therefor, the present invention is applicable to various apparatuses with an infrared sensor.

LIST OF REFERENCE NUMERALS

21 main body
21*a* bottom wall of main body
22 cooking container
23 top plate
24 heating coil
25 ferrite material
26 infrared sensor
26*a* printed circuit board (detection circuit)
27 control circuit
27*a* control board
28 magnetic flux-shielding plate
28*a* through-hole (magnetic flux-shielding plate)
29 coil base (heating coil holding plate)
31 spring
31*a* support
31*b* spring
32 fan
32*a*, 32*b* duct
33 cooling air trunk
34 cylindrical member
35*a*, 35*b* casing
35*c* flange (casing)
35*d* upper wall (casing)
35*e* through-hole (casing)
36*a* heat sink (cooling fin)
36*b* resonance capacitor (heat-generating component)
36*c* semiconductor element (heat-generating component)
37 light transmitting portion
38 light shielding film
39 light emitting ring
40 heating zone
41 control/display portion

The invention claimed is:

1. An induction heating cooking apparatus comprising:
a main body;
a top plate mounted on an upper surface of the main body to place a cooking container thereon;
a heating coil disposed below the top plate to heat the cooking container;
a plurality of ferrite materials disposed below the heating coil so as to extend radially from a center of the heating coil;
a heating coil holding plate holding the heating coil and the ferrite materials;
an infrared sensor disposed below the top plate to detect infrared rays emitted from the cooking container;
a control circuit disposed below the ferrite materials and comprising an inverter circuit operable to generate a high frequency current to be supplied to the heating coil and a semiconductor element operable to drive the inverter circuit, the control circuit controlling an output of the heating coil depending on an output from the infrared sensor;
a heat sink on which the semiconductor element is mounted, wherein the heat sink operable to cool the semiconductor element mounted thereto;
a magnetic flux-shielding plate interposed between the ferrite materials and the control circuit and, the magnetic flux-shielding plate being divided from the heat sink, the magnetic flux-shielding plate that supports the heating coil and the ferrite from below, and the magnetic flux-shielding plate being made of a metal plate to shield magnetic flux leakage downward from the ferrite materials;
a fan operable to convey cooling air to cool the control circuit and the heat sink; and
a duct that leads another flow of the cooling air from the fan toward neighborhood of the infrared sensor;
wherein the infrared sensor is positioned below the magnetic flux-shielding plate, and the fan conveys the cooling air to the heat sink and the another flow of the cooling air to the neighborhood of the infrared sensor below the magnetic flux-shielding plate through the duct.

2. The induction heating cooking apparatus according to claim 1, further comprising a cylindrical member interposed between the infrared sensor and the top plate so as to extend through the magnetic flux-shielding plate, wherein infrared rays emitted from the cooking container pass through the cylindrical member.

3. The induction heating cooking apparatus according to claim 1, wherein the infrared sensor and the heat sink is positioned in parallel with respect to the fan such that the cooling air from the fan to the infrared sensor along lower surface of the magnetic flux-shielding plate and the cooling air from the fan to a space between the magnetic flux-shielding plate and the heat sink flow in parallel to each other.

4. The induction heating cooking apparatus according to claim 1, further comprising a light emitting ring encircling an outer periphery of the heating coil, wherein the top plate comprises a light shielding film formed on a lower surface thereof confronting the heating coil to shield light and a light transmitting portion formed on the lower surface of the top plate to allow transmission of light by removing a portion of the light shielding film at a location confronting the light emitting ring, and wherein the magnetic flux-shielding plate confronts the light transmitting portion.

5. The induction heating cooking apparatus according to claim 4, further comprising a light absorbing film formed on the magnetic flux-shielding plate.

6. The induction heating cooking apparatus according to claim 1, further comprising a casing mounted to a lower surface of the heating coil holding plate to accommodate the infrared sensor therein, the casing extending through the magnetic flux-shielding plate.

7. The induction heating cooking apparatus according to claim 6, further comprising a detection circuit operable to detect an output from the infrared sensor, wherein the casing is formed of a conductive metallic material and held in contact with the detection circuit, but electrically insulated from the magnetic flux-shielding plate.

* * * * *